US011993411B2

(12) United States Patent
Lopes

(10) Patent No.: US 11,993,411 B2
(45) Date of Patent: May 28, 2024

(54) FILM DISPENSER FOR A WRAPPING APPARATUS AND RELATED METHODS

(71) Applicant: WULFTEC INTERNATIONAL INC., Ayer's Cliff (CA)

(72) Inventor: Guy Lopes, Sherbrooke (CA)

(73) Assignee: WULFTEC INTERNATIONAL INC., Québec (CA)

( * ) Notice: Subject to any disclaimer, the term of this patent is extended or adjusted under 35 U.S.C. 154(b) by 278 days.

(21) Appl. No.: 17/224,375

(22) Filed: Apr. 7, 2021

(65) Prior Publication Data

US 2021/0309401 A1 Oct. 7, 2021

Related U.S. Application Data

(60) Provisional application No. 63/006,326, filed on Apr. 7, 2020.

(51) Int. Cl.
*B65B 41/16* (2006.01)
*B65B 11/00* (2006.01)
(Continued)

(52) U.S. Cl.
CPC ..... *B65B 41/16* (2013.01); *B65B 11/00* (2013.01); *B65B 57/04* (2013.01); *B65B 59/003* (2019.05);
(Continued)

(58) Field of Classification Search
None
See application file for complete search history.

(56) References Cited

U.S. PATENT DOCUMENTS 3,591,065 A * 7/1971 Hansen, Jr. ..... B65B 41/16 226/25
5,017,819 A 5/1991 Patt et al.
(Continued)

FOREIGN PATENT DOCUMENTS

CN 105757153 A 7/2016

OTHER PUBLICATIONS

L. Encica et al., "Passive and Active Constant Force-Displacement Characteristics and Optimization of a Long-Stroke Linear Actuator," 11th International Conference on Optimization of Electrical and Electronic Equipment (OPTIM), Braşov, Romania, May 22-24, 2008, pp. 117-124.

*Primary Examiner* — William A. Rivera
(74) *Attorney, Agent, or Firm* — Ryan, Mason & Lewis LLP

(57) ABSTRACT

There is provided a film dispenser including a pre-stretch assembly, a dancer bar and a dancer bar control assembly. In response to a variation of a film feed requirement, the dancer bar is movable over a displacement range between a first position and at least one second position. The dancer bar is in the first position when a tension in the material web is below a threshold and in the at least one second position when the tension in the material web is equal to or above the threshold. The dancer bar control assembly is connected to the pre-stretch assembly and the dancer bar and is configured to bias the dancer bar with a constant force over the displacement range, monitor a displacement of the dancer bar and generate a speed command based thereon, and send the speed command to a motor to adjust the film delivery speed.

22 Claims, 10 Drawing Sheets

(51) Int. Cl.

| | |
|---|---|
| ***B65B 57/04*** | (2006.01) |
| ***B65B 59/00*** | (2006.01) |
| ***B65H 16/02*** | (2006.01) |
| ***B65H 23/04*** | (2006.01) |

(52) U.S. Cl.
CPC ..... *B65H 16/02* (2013.01); *B65H 23/044* (2013.01); *B65H 23/048* (2013.01); *B65B 2011/002* (2013.01); *B65B 2210/04* (2013.01); *B65H 2404/62* (2013.01)

(56) References Cited

U.S. PATENT DOCUMENTS 5,148,066 A 9/1992 Beale et al.
5,414,979 A * 5/1995 Moore ..... B65B 53/00 53/556
5,765,344 A * 6/1998 Mandeville ..... B65B 11/025 53/556
7,121,980 B2 10/2006 Chen
2007/0204565 A1* 9/2007 Lancaster, III ..... B65B 11/025 53/399
2008/0297074 A1 12/2008 Sheahen, Jr. et al.
2009/0120307 A1* 5/2009 Koskela ..... B65B 11/045 100/27
2009/0235617 A1* 9/2009 Moore ..... B65B 11/045 53/461
2011/0179752 A1* 7/2011 Lancaster, III ..... B65B 11/008 53/556
2013/0227919 A1* 9/2013 Cousins ..... B65B 11/06 53/556
2014/0116007 A1* 5/2014 Lancaster, III ..... B65B 11/025 53/64
2017/0088301 A1* 3/2017 Riemenschneider, III ..... B65B 59/003
2017/0101205 A1* 4/2017 Schieck ..... B65B 11/025
2020/0231312 A1* 7/2020 Cere' ..... B65B 57/04
2020/0283176 A1* 9/2020 Lancaster, III ..... B65B 11/045
2020/0377250 A1* 12/2020 Lancaster, III ..... B65H 23/185
2022/0219930 A1* 7/2022 Gerri ..... B65B 41/12

* cited by examiner

FILM DISPENSER FOR A WRAPPING APPARATUS AND RELATED METHODS

CROSS-REFERENCE TO RELATED APPLICATIONS

This application claims priority under 35 USC § 119(e) of U.S. provisional patent application 63/006,326 filed Apr. 7, 2020, the specification of which is hereby incorporated by reference.

FIELD

The present disclosure relates to wrapping apparatuses, namely apparatuses for wrapping a load with a web of film. More particularly, the present disclosure relates to a film dispenser for such wrapping apparatuses.

BACKGROUND

Typical loads, such as a bundle of grouped items, have a rectangular cross-section or other non-circular cross-sections. Due to corner variations which change the effective wrapping radius, such loads present a fluctuation in their demand for film web when the film web is wrapped around their periphery. More particularly, when a relative rotation is provided between the load and the film dispenser, the film dispenser needs to accelerate or decelerate around the load corners to maintain a constant film tension on the load.

The film feed requirement of a load can be sensed by a dancer bar. Dancer bars used in conventional film dispensers are generally biased towards a first position with non-linear biasing means, i.e., the force exerted by the non-linear biasing means generally increases with an increasing displacement. Such non-linear biasing means are difficult to model, and their control remains a challenge, notably because the system behaviour, as well as its reaction, vary in accordance with the position of the dancer bar relative to the first position.

There is a need in the industry for a film dispenser for a wrapping apparatus that alleviates at least in part the deficiencies of existing film dispensers and seeks to solve problems and drawbacks of the prior art.

SUMMARY

In accordance with one aspect, there is provided a film dispenser for a wrapping apparatus, including:

- a dispenser roller to receive and support a material web;
- a film dispenser motor operatively connected to the dispenser roller;
- a pre-stretch assembly configured to pre-stretch the material web and provide the material web at a film delivery speed, the pre-stretch assembly including a pre-stretch motor;
- a dancer bar positioned downstream of the pre-stretch assembly and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal to or above the threshold; and

- a dancer bar control assembly operatively connected to the pre-stretch assembly and to the dancer bar, the dancer bar control assembly being configured to:
  - bias the dancer bar with a constant force over the displacement range;
  - monitor a displacement of the dancer bar; and
  - generate a speed command based on the monitored displacement of the dancer bar and send the speed command towards the film dispenser motor or the pre-stretch motor to adjust the film delivery speed.

In some embodiments, a value of the constant force is adjustable.

In some embodiments, the dancer bar control assembly includes:

- a biasing actuator configured to bias the dancer bar towards the first position;
- a dancer bar displacement sensor configured to monitor the displacement of the dancer bar relative to the first position; and
- a controller operatively connected to the dancer bar displacement sensor and to one of the pre-stretch motor and the film dispenser motor, the controller being configured to generate and send the speed command.

In some embodiments, the displacement of the dancer bar is a translation between the first position and the at least one second position.

In some embodiments, the dancer bar control assembly includes:

- a first linear servo motor operatively connected to a first end of the dancer bar, the first linear servo motor being configured to detect and guide a translation of the first end along a first axis; and
- a second linear servo motor operatively connected to a second end of the dancer bar, the second linear servo motor being configured to detect and guide a translation of the second end along a second axis.

In some embodiments, the first and second axes are substantially parallel one to another.

In some embodiments, the displacement of the dancer bar is a rotation between the first position and the second position and the dancer bar is rotatable about a rotation axis.

In some embodiments, the dancer bar control assembly includes a rotatory servo motor operatively connected to a first end of the dancer bar, the rotatory servo motor being configured to detect and guide a rotation of the first end about the rotation axis.

In some embodiments, the rotatory servo motor is configured to measure an angular displacement of the dancer bar.

In some embodiments, the dancer bar control assembly includes:

- a magnetic assembly including a permanent magnet mounted inside the dancer bar and an inductive magnet mounted around the dancer bar; and
- an angular position sensor configured to measure an angular position of the dancer bar.

In some embodiments, the dancer bar control assembly includes:

- a magnetic assembly comprising an inductive magnet mounted inside the dancer bar and a permanent magnet mounted around the dancer bar; and
- an angular position sensor configured to measure an angular position of the dancer bar.

In some embodiments, the dancer bar control assembly includes:

- a magnetic assembly, including:
- a magnetic spring;

a reel mountable near or at a first end of the dancer bar, the reel being engageable in rotation with the dancer bar; and a cable operatively connected to the magnetic spring, the cable being wounded around the reel upon rotation of the dancer bar; and a linear displacement sensor configured to measure a linear displacement of the cable.

In some embodiments, the threshold is a tension value.

In some embodiments, the threshold is about 10 pounds.

In some embodiments, the threshold is adjustable.

In some embodiments, wherein the dispenser roller is configured to support a roll of the material web and is located upstream of the pre-stretch assembly and wherein the pre-stretch assembly includes:

a first pre-stretch roller; and a second pre-stretch roller mechanically connected to the first pre-stretch roller and located downstream of the first pre-stretch roller.

In some embodiments, second pre-stretch roller is mechanically connected to the first pre-stretch roller with a belt.

In some embodiments, the pre-stretch motor is operatively connected to the second pre-stretch roller.

In some embodiments, the pre-stretch motor is operatively connected to a roller mechanically connected to the second pre-stretch roller, the roller being mechanically connected to the second pre-stretch roller with a belt.

In some embodiments, the film dispenser motor is in driving engagement with the film dispenser, the film dispenser motor driving the film dispenser in relative rotation with respect to a load.

In accordance with another aspect, there is provided a film dispenser for a wrapping apparatus, including:

a pre-stretch assembly configured to pre-stretch a material web and provide the material web at a film delivery speed;

a dancer bar positioned downstream of the pre-stretch assembly and being engageable with the material web, the dancer bar being movable over a displacement range between a first position and a second position in response to a variation of a film feed requirement, the dancer bar being in the first position when a tension in the material web is below a threshold and being in the second position when the tension in the material web is equal to or above the threshold; and a dancer bar control assembly operatively connected to the pre-stretch assembly and to the dancer bar, the dancer bar control assembly being configured to:

bias the dancer bar with a constant force over the displacement range;

measure a position of the dancer bar; and adjust the film delivery speed based on the measured position.

In accordance with another aspect, there is provided a method for dispensing a film, including:

providing a material web at a film delivery speed;

engaging a dancer bar with the material web, the dancer bar being movable over a displacement range in response to a variation of a film feed requirement;

biasing the dancer bar with a constant force over the displacement range;

monitoring a displacement of the dancer bar; and adjusting the film delivering speed based on the displacement of the dancer bar, thereby compensating for the variation of the film feed requirement.

In some embodiments, the method of claim includes pre-stretching the material web.

In some embodiments, monitoring the displacement of the dancer bar includes monitoring a translation of the dancer bar between a first angular position and at least one second angular position.

In some embodiments, monitoring the displacement of the dancer bar includes monitoring a rotation of the dancer bar between a first position and at least one second position.

In some embodiments, the threshold is a tension value.

In some embodiments, the threshold is comprised in a range extending from about 1 pound to about 20 pounds.

In some embodiments, the method further includes adjusting the threshold.

In accordance with another aspect, there is provided a film dispenser for a wrapping apparatus, including:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards the film dispenser motor to adjust the film delivery speed.

In some embodiments, the value of the constant force is adjustable.

In some embodiments, the dancer bar control assembly includes:

a biasing actuator configured to bias the dancer bar towards the first position;

a dancer bar displacement sensor configured to monitor the displacement of the dancer bar relative to the first position; and a controller operatively connected to the dancer bar displacement sensor and to the film dispenser motor, the controller being configured to generate and send the speed command.

In some embodiments, the displacement of the dancer bar is a translation between the first position and the at least one second position.

In some embodiments, the dancer bar control assembly includes:

a first linear servo motor operatively connected to a first end of the dancer bar, the first linear servo motor being configured to detect and guide a translation of the first end along a first axis; and a second linear servo motor operatively connected to a second end of the dancer bar, the second linear servo motor being configured to detect and guide a translation of the second end along a second axis.

In some embodiments, the first and second axes are parallel one to another.

In some embodiments, the displacement of the dancer bar is a rotation between the first position and the second position and the dancer bar is rotatable about a rotation axis.

In some embodiments, the dancer bar control assembly includes a rotatory servo motor operatively connected to a first end of the dancer bar, the rotatory servo motor being configured to detect and guide a rotation of the first end about the rotation axis.

In some embodiments, the rotatory servo motor is configured to measure an angular displacement of the dancer bar.

In some embodiments, the dancer bar control assembly includes:

- a magnetic assembly including a permanent magnet mounted inside the dancer bar and an inductive magnet mounted around the dancer bar; and
- an angular position sensor configured to measure an angular position of the dancer bar.

In some embodiments, the dancer bar control assembly includes:

- a magnetic assembly, including:
  - a magnetic spring;
  - a reel mountable near or at a first end of the dancer bar, the reel being engageable in rotation with the dancer bar; and
  - a cable operatively connected to the magnetic spring, the cable being wounded around the reel upon rotation of the dancer bar; and
- a linear position sensor configured to measure a linear displacement of the cable.

In some embodiments, the threshold is a tension value.

In some embodiments, the threshold is comprised in a range extending from about 1 pound to about 20 pounds.

In some embodiments, the threshold is adjustable.

In some embodiments, the film dispenser motor is in driving engagement with the film dispenser, the film dispenser motor driving the film dispenser in relative rotation with respect to a load.

These and other aspects of the technology will now become apparent to those of ordinary skill in the art upon review of the following description of embodiments of the technology in conjunction with the accompanying drawings.

BRIEF DESCRIPTION OF THE DRAWINGS

A detailed description of the embodiments of the present technology is provided herein below, by way of example only, with reference to the accompanying drawings, in which.

Figure 1:
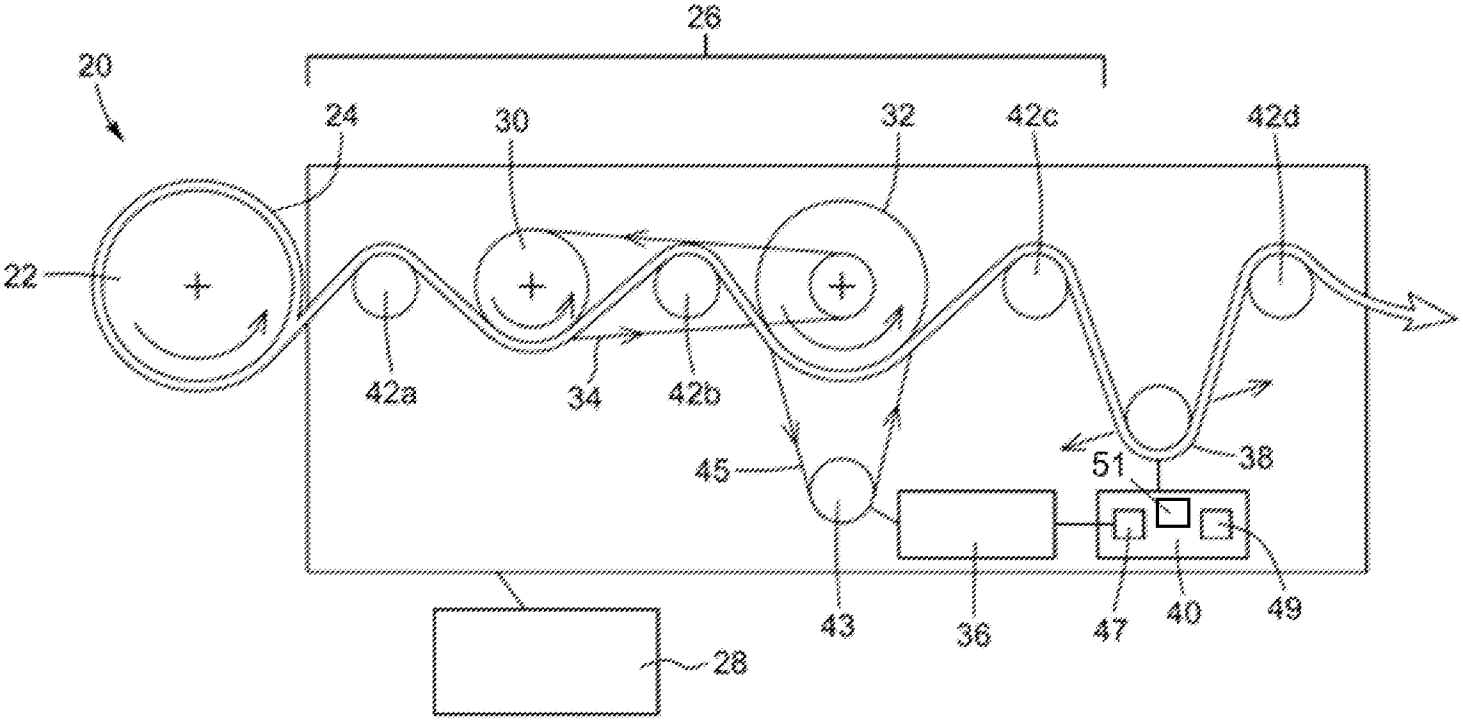
FIG. 1 is a schematic representation of a film dispenser for a wrapping apparatus, in accordance with an embodiment.

In the drawings, embodiments of the technology are illustrated by way of examples. It is to be expressly understood that the description and drawings are only for the purpose of illustration and are an aid for understanding. They are not intended to be a definition of the limits of the technology.

DETAILED DESCRIPTION OF EMBODIMENTS

Before any variants, examples or embodiments of the technology are explained in detail, it is to be understood that the technology is not limited in its application to the details of construction and the arrangement of components set forth in the following description or illustrated in the drawings. The technology is capable of other variants or embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. Similarly, the words "left", "right", "front" and "rear" designate locations or positions in the drawings to which reference is made. The terminology includes the words specifically mentioned above, derivatives thereof, and words or similar import.

Variants, examples and embodiments of the technology are described hereinbelow.

The need for the film dispenser and related methods which will be described in the current description arises, inter alia, from the fact that the dancer bars of prior art are typically biased towards their initial position (sometimes referred to as a "zero position" or a "first position") with non-linear biasing means, meaning that the force exerted by the non-linear biasing means on the dancer bar increases with increasing displacement. Systems including such non-linear biasing means and methods relying on the same are known to be difficult to model, and so to control, since the system's behaviour generally varies depending on the relative position of the dancer bar with respect to its zero position.

The present disclosure addresses the need for a system and related methods in which a constant force can be generated over the entire displacement range or working range (or "stroke") of the biasing assembly or means. Even though the generated force is constant over the entire displacement range or working range (or "stroke"), the force is adjustable (i.e., the magnitude of the constant force can be modified, changed, varied, or adjusted). As it will be described in greater detail below, such a system and related methods can be useful for providing feedback during a wrapping cycle of a load without creating tension peaks, thereby mitigating, or eliminating the negative effects generally associated with such tension peaks. Tension peaks may cause, for example, and without being limitative, damages in the material web or film being dispensed on the load, improper or non-optimal stretching of the material web (in the case of stretchable material webs), and many other issues that may negatively affect or compromise the wrapping cycle of the loads.

Referring to FIG. 1, a schematic representation of a film dispenser 20 is shown. The structural and operational features of the film dispenser 20 and its components will now be broadly described.

As illustrated, the film dispenser 20 includes a roll support 22 for rotatably supporting a roll of a material web 24 (sometime referred to as a "wrapping film") to be dispensed. Of note, the roll support 22 is sometimes referred to as a "dispenser roller". The material web 24 may be a film made from any types of material such as, to name a few, polymer, plastic, paper, and many others. It should be noted that the material web 24 may either be stretchable, non-stretchable, or exhibit a certain degree of stretchability. The selection of adequate materials and/or properties (e.g., stretchability) for the material web 24 may depend on a plurality of factors, such as, for example, and without being limitative, dimensions of the loads, geometry of the loads, the nature of the products being wrapped, shipping conditions, and many other parameters that would be readily identified as being relevant for a person skilled in the art. In some embodiments, the material web 24 may be a polymeric film dispensed in a web form. The roll support (or dispenser roller) 22 is sized and configured for supporting a roll of the material web 24.

In some embodiments, such as the one illustrated in FIG. 1, the film dispenser 20 includes a pre-stretch assembly 26 configured to pre-stretch the material web 24 as it is unwound from the roll support 22. In these embodiments, the material web 24 is stretchable or should at least exhibit a certain degree of stretchability. A nonlimitative example of a material being suitable for a stretchable material web 24 is a polymeric film. Alternatively, in other embodiments that will be described in greater detail below with reference to FIG. 6, the film dispenser 20 does not include a pre-stretch assembly 26. In these embodiments, the material web 24 is generally non-stretchable. A nonlimitative example of a material being suitable for a non-stretchable material web 24 is a paper film. It can also exhibit stretchability to a different degree and can be supplied with or without a pre-stretch assembly.

As illustrated in FIG. 1, the roll support (or dispenser roller) 22 is located upstream of the pre-stretch assembly 26, if any. In some embodiments, the film dispenser 20 includes a film dispenser motor 28. In other embodiments, the film dispenser motor 28 is a separate component (i.e., is not a part of the film dispenser 20) but is rather operatively connected to the film dispenser 20. Notwithstanding the configuration of the film dispenser motor 28 (i.e., the film dispenser 20 including or not including the film dispenser motor 28), when in operation, the film dispenser 20 can be driven in relative rotation with respect to the load, as it is known in the art. For example, and without being limitative, the film dispenser motor 28 may be in driving engagement with the film dispenser 20.

In the depicted embodiment of FIG. 1, the pre-stretch assembly 26 includes a first pre-stretch roller 30 and a second pre-stretch roller 32. In this nonlimitative embodiment, the second pre-stretch roller 32 is operatively connected to the first pre-stretch roller 30 and located downstream of the first pre-stretch roller 30. As illustrated, the first and the second pre-stretch rollers 30, 32 are mechanically connected to each other by a belt 34. One would readily understand that the number or pre-stretch roller can vary, and that the fact that FIG. 1 shows two pre-stretch rollers 30,32 serves an illustrative purpose only. As such, the pre-stretch assembly 26 could comprise any number of pre-stretch roller(s) that are needed to pre-stretch the web material. It is also to be noted that while the first and second rollers 30,32 are illustrated as being mechanically connected with the belt 34, the first and second rollers 30,32 could be connected by any other mechanical, electrical and/or electronic control components allowing the first and second rollers 30,32 to be engageable in rotation one with another or to control the rotational speed of the one of the first and second rollers 30, 32 based on the rotational speed of the other one of the first and second rollers 30, 32. More specifically, the connection between the first and second pre-stretch rollers 30,32 is such that a revolution imparted to one of the two rollers will cause the other one of the two rollers to rotate. In some embodiments, the rotational speed of the second pre-stretch roller 32 is geared to be faster than the first pre-stretch roller 30 to pre-stretch the material web before being delivered to the load. Such a selection can be set before the wrapping cycle or could be adjusted during the wrapping cycle. In the illustrated embodiment of FIG. 1, the ratio of the gear between the first and second pre-stretch rollers 30,32 is such that, after its passage through the pre-stretch assembly 26, the material web 24 is pulled and stretched between the first and second pre-stretch rollers 30,32. The ratio of relative rotational speed between the first and second pre-stretch rollers 30,32 can be adjusted depending on the desired amount of pre-stretching and can be predetermined or determined while the load is being wrapped.

In the embodiment shown in FIG. 1, the pre-stretch assembly 26 includes a pre-stretch motor 36 to directly or indirectly impart the rotational movement to the first and second pre-stretch rollers 30,32. As shown in FIG. 1, the pre-stretch motor 36 is mechanically connected to the second pre-stretch roller 32. In some embodiments, the pre-stretch motor 36 may be connected through a roller 43 and a belt 45 to the second pre-stretch roller 32. As such, the pre-stretch motor 36 is in driving engagement with the second pre-stretch roller 32 and is operable to set the film delivery speed. One would readily understand that the belt 45 serves an exemplary purpose only, and that the belt could be replaced by any other mechanical component(s) allowing to transfer and/or convert the power generated by the pre-stretch motor 36 to second pre-stretch roller 32. As such, the pre-stretch motor 36 can drive the belt 45 through the roller 43, which in turn rotates the second pre-stretch roller 32. The rotation speed of the second pre-stretch roller 32 defines the film delivery speed (sometimes referred to as "film feed speed"). In the context of the current description, the expression "film delivery speed" refers to the rate at which the web material 24 (i.e., the film) is supplied to the load by the film dispenser 20 (whether the film dispenser 20 includes a pre-stretch assembly or not). In the depicted embodiment of FIG. 1, the first and second pre-stretch rollers 30,32 are mechanically connected by the belt 34. As such, the movement imparted by the pre-stretch motor 36 to the second pre-stretch roller 32, through the roller 43 and the belt 45 is subsequently transferred to the first pre-stretch roller 30 via the belt 34. One would readily understand that the rotation speed of at least one of the first and second pre-stretch rollers 30,32 can thus be directly or indirectly adjusted by the pre-stretch motor 36. In other embodiments, the pre-stretch motor 36 could be mechanically connected to the first pre-stretch roller 30, rather than the second pre-stretch roller 32.

The film dispenser 20 includes a dancer bar 38 (sometimes referred to as "dancer roller" or "dancer arm"). In some embodiments, the dancer bar 38 is free to pivot or translate in response to variations in film demand, which will be referred to as variations of a film feed requirement.

The film dispenser 20 includes a dancer bar control assembly 40 including a biasing actuator 47 configured to bias the dancer bar 38 towards its zero position and a sensor 49 configured to monitor the position of the dancer bar 38 relative to the zero position. In the illustrated embodiment, the dancer bar control assembly 40 is shown as being connected to the dancer bar 38, but one would readily understand that such a connection is only schematic and serves the purpose of illustrating the operational relation between the dancer bar 38 and the dancer bar control assembly 40. In some embodiments, the dancer bar control assembly 40 may include a controller 51 operatively connected to at least one of the biasing actuator 47, the sensor 49, the pre-stretch motor 36 of the pre-stretch assembly 26 and the film dispenser motor 28. As illustrated in FIG. 1, the controller 51 is connected to the pre-stretch motor 36. The controller 51 can be programmed to modify the speed, acceleration and/or deceleration of the pre-stretch motor 36 or the speed, acceleration and/or deceleration of the film dispenser motor 28 in accordance with the position of the dancer bar 38, as monitored by the sensor 49, and thereby adjust the film delivery speed or the relative rotation speed between the load and the film dispenser 20 accordingly. The dancer bar control assembly 40 acts as a control loop, which can be, for example and without being limitative, a feedback control loop. Thus, the dancer bar control assembly 40 is configured to associate a position of the dancer bar 38, relative to the zero position, with the film feed requirement and to adjust the film delivery speed or the relative rotation between the load and the film dispenser 20 accordingly. For example, when there is no tension applied on or to the dancer bar 38 or when the tension applied on the dancer bar 38 is lower (or equal) than a threshold, the dancer bar 38 remains at a first position (i.e., the initial position or a zero position). When the dancer bar 38 is located at the first position, the film delivery speed is unchanged, and so remains substantially constant over time or over a certain period of time. In this scenario, there is no change in the film feed requirement, or the variation of the film feed requirement is below a threshold, and so there is no need in adjusting the film delivery speed. When there is a tension applied on or to the dancer bar 38 that reaches or is above the threshold, the dancer bar 38 position differs from the first position and moves towards a second position, spaced-apart from the first position.

Figure 6:
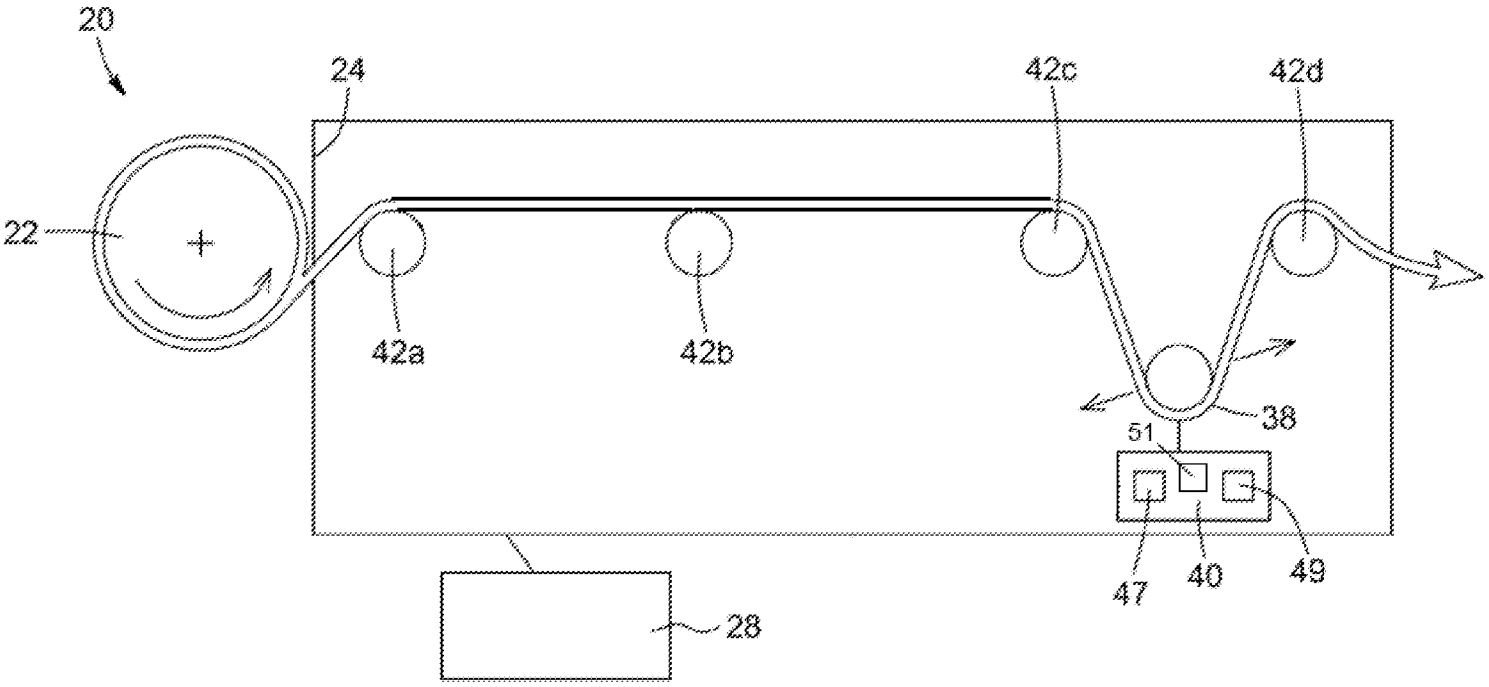
FIG. 6 is a schematic representation of a film dispenser for a wrapping apparatus, in accordance with another embodiment.

The dancer bar control assembly 40 is configured to bias the dancer bar 38 with a constant force over the whole displacement range of the dancer bar 38 (i.e., the displacement between the first position and the at least one second position). In the context of the current description, the expression "bias" refers to the fact that the dancer bar control assembly 40 is configured to exert a force on the dancer bar 38. As it will be explained in greater detail below, the force can either be a translational force or a rotational force, depending on the configuration of the dancer bar control assembly 40. The biasing force exerted by the dancer bar control assembly 40 is substantially constant over the entire displacement range of the dancer bar 38. In some implementations, the constant force is adjustable, meaning that the force, when set, remains constant over the entire displacement range, but that the value of the force can be adjusted, modified, altered, or determined a priori. The dancer bar control assembly 40 is also configured to monitor a displacement of the dancer bar 38, for example using the actuator 47, the sensor 49 and/or the controller 51 and determine the film feed requirement based on the displacement of the dancer bar 38. The expression "monitor" herein refers to detecting, measuring, recording, watching and/or observing the displacement of the dancer bar 38. The dancer bar control assembly 40 (e.g., the controller 51) is also configured to generate a speed command based on the film feed requirement and send the speed command towards the pre-stretch assembly 26 to adjust the film delivery speed, thereby compensating for the variation of the film feed requirement during the wrapping cycle. As such, the dancer bar control assembly 40 receives the displacement of the dancer bar 38 as an input and produces a command, namely a speed command, as an output, the command being a dispenser motor 28 (e.g., when the film dispenser 20 does not include a pre-stretch assembly 26, as illustrated in FIG. 6) or to the pre-stretch motor 36 of the pre-stretch assembly 26 (e.g., when the film dispenser 20 includes such a pre-stretch assembly 26, as illustrated in FIG. 1), such that the film delivery speed can be adjusted. As such, the adjustment of the film delivery speed is achieved with the dispenser roller 22 or pre-stretch assembly 26. When the adjustment of the film delivery speed is achieved with the pre-stretch assembly 26, the speed of the rotation of the first and the second pre-stretch rollers 30,32 may be changed or altered with the pre-stretch motor 36. Simply put, the dancer bar control assembly 40 is configured to bias the dancer bar 38 with a constant force over the displacement range, monitor a displacement of the dancer bar 38 and generate a speed command based on the monitor displacement of the dancer bar 38 and send the speed command towards the dispenser motor 28 or the pre-stretch motor 36 to adjust the film delivery speed. In some embodiments, the dancer bar control assembly 40 can send the command to the dispenser motor 28 to adjust the relative rotation between the load and the film dispenser 20 and, thereby, the film delivery speed.

In some embodiments, such as the one illustrated in FIG. 1, the dancer bar control assembly 40 is operatively connected to the dancer bar 38 and to the pre-stretch assembly 26. In some embodiments, the dancer bar control assembly 40 is configured to detect a change of position of the dancer bar 38 (e.g., detects that the dancer bar 38 is in the second position. i.e., in a position different than the first position) and sends a signal representative of the displacement of the dancer bar 38 to the pre-stretch motor 36 or the film dispenser motor 28 which, in turn, adjusts the film delivery speed (sometimes referred as the "feed rate") of the film accordingly. In some embodiments, the signal is a time-varying signal, and this time-varying signal is proportional to displacement of the dancer bar 38.

It is understood that the dancer bar 38 has one first position but can have one or more second positions. More particularly, the expression "second position" refers to any position(s) different than the first position. The displacement of the dancer bar 38 from the first position towards the second position(s) can be a translation or a rotation. The displacement range includes at least the first and the second position and is continuous. In some embodiments, the dancer bar 38 can continuously move from the first position to the second position upon the variation of the film feed requirement.

In the illustrated embodiment of FIG. 1, the film dispenser 20 also includes four fixed rollers 42*a,d* arranged to guide the wrapping film (or material web 24) as it travels through the film dispenser 20. In the illustrated example, a first fixed roller 42*a* is located between the roll support 22 and the first pre-stretch roller 30, a second fixed roller 42*b* is located between the first pre-stretch roller 30 and the second pre-stretch roller 32, a third fixed roller 42*c* is located between the second pre-stretch roller 32 and the dancer bar 38 and a fourth fixed roller 42*d* is located downstream of the dancer bar 38. One would readily understand that the number and the configuration of the fixed rollers shown in FIG. 1 serve an illustrative purpose only, and that other configurations could be implemented, as long as the material web 24 can be conveyed through the film dispenser 20, and ultimately be dispensed to the load.

Referring to FIGS. 2A to 5B, there are provided different embodiments of a dancer bar control assembly 40 for a film dispenser 20 for a wrapping apparatus. The embodiments of the film dispenser 20 which will now be described include at least some of the components described above.

As previously presented, the film dispenser 20 may include, in some embodiments, a pre-stretch assembly 26 configured to pre-stretch a material web 24 and provide the material web 24 at a film delivery speed (see for example FIG. 1). It should however be noted that the pre-stretch assembly 26 is optional in the film dispenser 20, and that even some of the following embodiments are described as including a pre-stretch assembly 26, these embodiments could alternatively be exempt of such a pre-stretch assembly 26 (see for example FIG. 6).

In some embodiments, the film dispenser 20 includes a dancer bar 38 positioned downstream of the pre-stretch assembly 26 and engageable with the material web 24, such that, in response to a variation of a film feed requirement, the dancer bar 38 is movable (either translatable or rotatable) over a displacement range between a first position and at least one second position. The dancer bar 38 may be in the first position when a tension in the material web 24 is below a threshold and may be in the at least one second position when the tension in the material web 24 is equal or above the threshold. For example, in some implementations, the dancer bar 38 can either move from the first position towards the at least one second position (referred as the "second position") when the tension in the material web 24 is equal or above the threshold or remain in the first position when the tension in the film is below the threshold. The position of the dancer bar 38 when the tension is equal or above the threshold is generally correlated to the tension applied thereon by the material web 24 as it is supplied. In some embodiments, the dancer bar 38 includes a pivoting roller which pivots as the load demands more or less film fed.

In some embodiments, the dancer bar control assembly 40 is embodied by a feedback control loop. In some embodiments, the feedback control loop may be operatively connected to the dancer bar 38 and to the pre-stretch assembly 26 (when the film dispenser includes a pre-stretch assembly 26, see for example FIG. 1). Alternatively, in some embodiments, the feedback control loop may be operatively connected to the dancer bar 38 and to the roll support 22 (see for example FIG. 6). The feedback control loop is configured to monitor a position of the dancer bar 38. As it has been previously mentioned, the dancer bar control assembly 40 is configured to bias the dancer bar 38 with a constant force over the displacement range. The dancer bar control assembly 40 is also configured to receive a measured position of the dancer bar 38 and adjust the film delivery speed to compensate for the variation of the film feed requirement based on the measured position. The feedback control loop is configured to perform the same steps.

As already described in the context of the current disclosure, the dancer bar control assembly 40 is configured to exert a constant force (e.g., tension), i.e., a substantially non-variable force on the dancer bar 38, despite the displacement of the dancer bar 38. As such, the constant force is said to be independent from the displacement of the dancer bar 38. Amongst other, the dancer bar control assembly 40 according to the current disclosure differs from other biasing assemblies, such as, for example and without being limitative, biasing assemblies of prior art exerting a variable force on the dancer bar (by contrast to the dancer bar control assembly 40 exerting a constant force over the entire displacement range of the dancer bar 38). These assemblies of prior art that apply a variable force are generally such that the force being exerted on the dancer bar is typically greater as the displacement increases.

In a first example of dancer bars from prior art, the dancer bar is coupled with a biasing means including a torsion spring, which biases the dancer bar towards the first position. In a second example of dancer bars from prior art, the dancer bar is mounted through a non-linear biasing means including a pulley and a cable operatively connected to a spring. In these two examples from prior art, the dancer bar is biased towards its original (first) position in such a way that the force exerted on the dancer bar increases as the displacement increases (i.e., the force to be exerted increases with the displacement). In the assemblies of prior art, the position of the dancer bar is typically sensed or monitored by a cam. The cam is operatively connected to a controller which, in turn, is operatively connected to a film dispenser actuator, such as, for example and without being limitative, a motor. The rotation speed of the motor, which is associated with the film dispensing speed can be adjusted in a closed feedback control loop, based on the position of the dancer bar. However, adjusting the film dispensing speed with the closed feedback control loop is associated with a delay between the demand for the web material and the adjustment of the film dispensing speed. Furthermore, the fact that the force increases as the displacement increases makes the modeling of such assemblies of prior art relatively complex.

The dancer bar control assembly 40 according to the current disclosure mitigates the abovementioned challenges by providing an adjustable yet constant force over the entire range of displacement (translational or rotational) of the dancer bar 38. The adjustable and constant force can be useful, for example and without being limitative, for varying the amount of tension during the wrapping cycle, thereby reducing, or eliminating, tension peaks. For instance, the adjustable constant force allows to wrap a one load with a tight web material and to wrap another load with a more flexible (i.e., less tight, or looser) web material. The adjustable and constant force could also be useful to wrap a first portion and a second portion of a load with different level of tension (e.g., the first portion could be the lower portion of the load and could be more tightly wrapped than the second portion, which would be the upper portion of the load in this example). Such an adjustable and constant force could also be useful when the film demand varies during a wrapping cycle, for example and without being limitative in portions located near or at the corners of the load.

Different embodiments employing or relying on a dancer bar control assembly 40 will now be described.

Figure 2A:
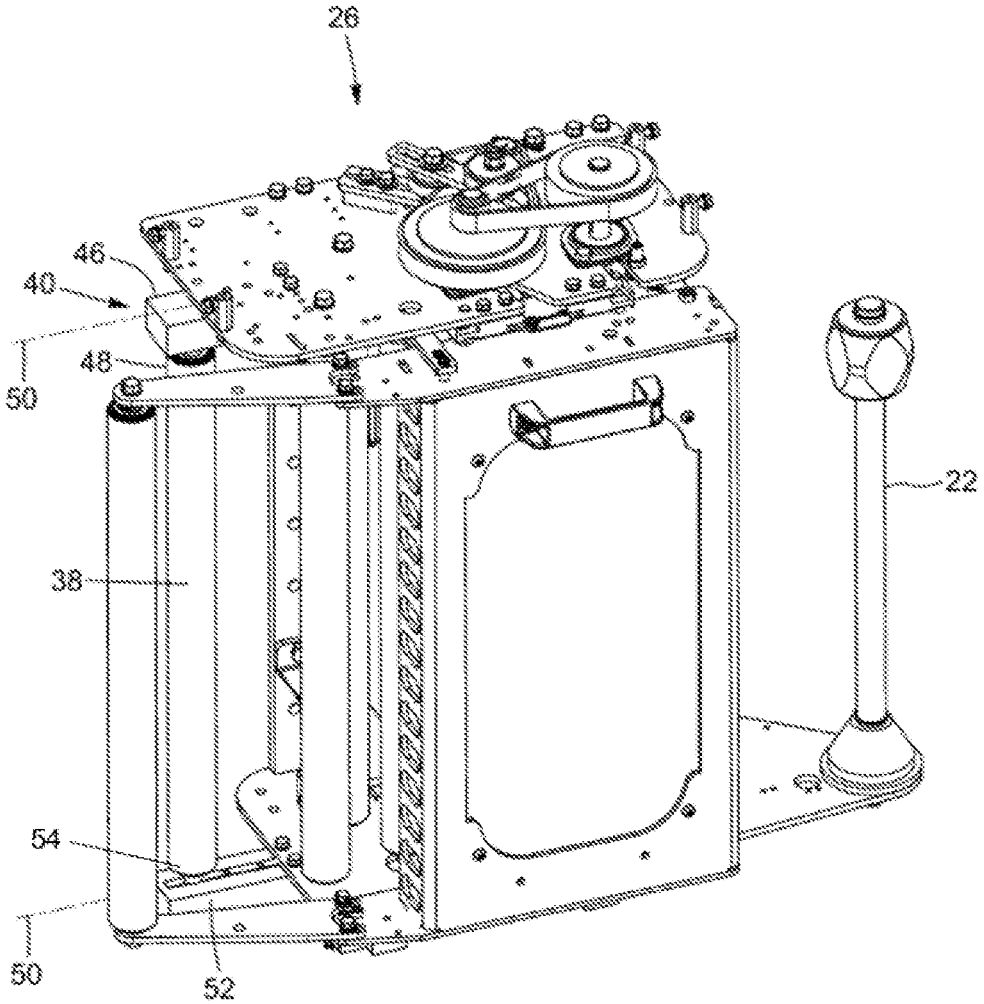
FIGS. 2A-B are respectively a perspective view and a front view of a dancer bar assembly for a film dispenser, in accordance with an embodiment wherein a dancer bar is operatively connected to a linear servo motor.
Figure 2B:
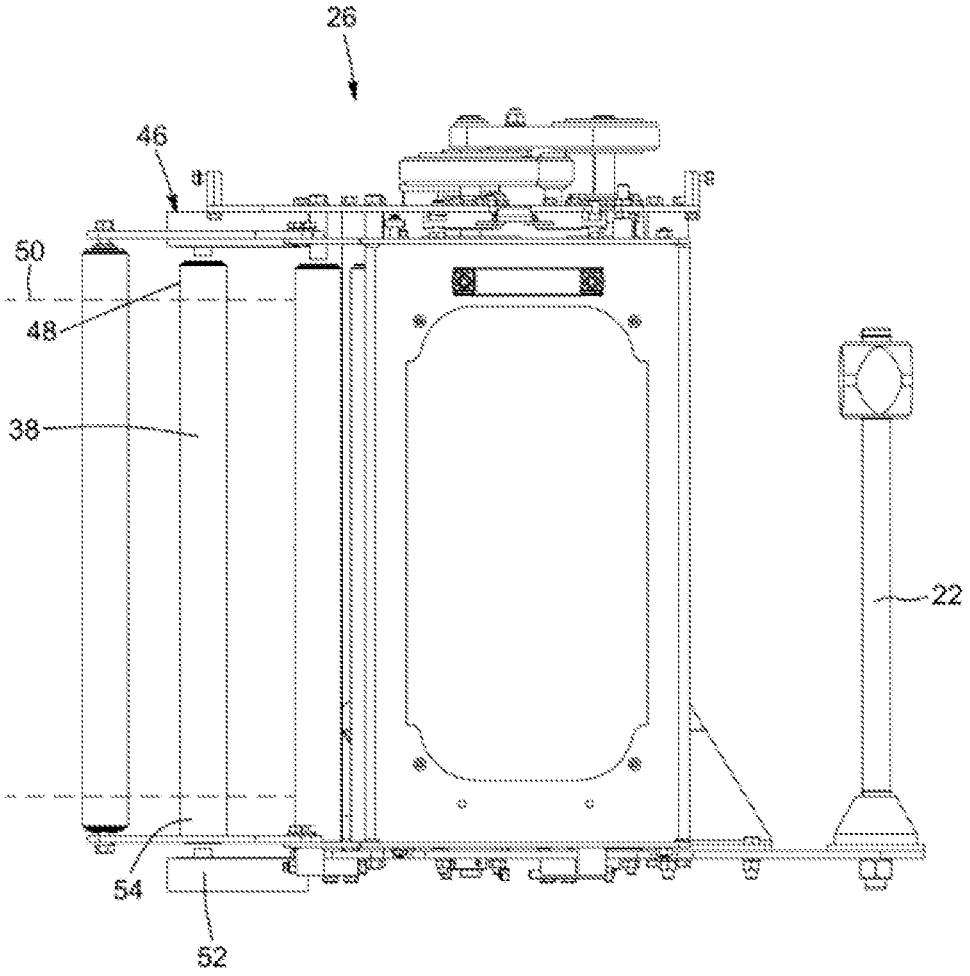

In some embodiments, such as the one illustrated in FIGS. 2A-B, the dancer bar 38 is displaceable along a translational degree of freedom, extending along an axis 50 from a first position towards the at least one second position, i.e., the displacement of the dancer bar 38 is a translation (i.e., a one-dimensional displacement or a displacement in a plane parallel or coinciding with the axis 50) between the first position and the at least one second position. In these embodiments, the dancer bar control assembly 40 includes a first linear servo motor 46 operatively connected to a first end 48 of the dancer bar 38, the first linear servo motor 46 being configured to measure and guide a translation of the first end 48 along the axis 50. The dancer bar control assembly 40 also includes a second linear servo motor 52 operatively connected to a second end 54 of the dancer bar 38, the second linear servo motor 52 being configured to measure and guide a translation of the second end 54 along the axis 50. For example, in the depicted embodiment, the axis 50 is substantially horizontal (i.e., extending in a direction substantially perpendicular to the force of gravity). The first and the second positions of the dancer bar 38 are in the same direction (i.e., a segment or a projected segment could join the first position to the second position), and more particularly extend in the same plane.

In these embodiments, the linear displacement of the dancer bar 38 is monitored and controlled by the first and/or second linear servo motors 46,52 located at each end of the dancer bar 38. The first and second linear servo motors 46,52 can bias the dancer bar 38 with a constant force along the displacement range of the dancer bar 38 in response to a variation in the film feed requirement. In some embodiments, the force is adjustable, meaning its set-point can be adjusted and/or predetermined. In some embodiments, the first and second linear servo motors 46,52 are configured to monitor, detect, and measure the translational position (or a variation thereof) of the dancer bar 38 in real-time or near real-time. More particularly, at least one of the first and second linear servo motors 46,52 is configured to track the translational positioning of the dancer bar 38. When the first and/or second servo motors 46,52 detect that the dancer bar 38 is in the first position (i.e., when there is no tension applied on or to the dancer bar 38, or when the tension is below or equal to the threshold), the first and second linear servo motors 46,52 remain in standby. However, when the threshold is reached, the dancer bar 38 moves towards the second position, following a translational movement. The first and second servo motors 46,52 are configured to measure the linear displacement of the dancer bar 38 and bias the dancer bar 38 with a constant force. Upon detection of a displacement equal or above the threshold, the first and second servo motors 46,52 are configured to send a speed command to the pre-stretch assembly 26 (or the film dispenser) to adjust the film delivery speed, thereby engaging the dancer bar 38 in translation towards its first position. Appropriate sensor(s), actuator(s) and/or controller(s), such as the ones which have been previously described, could be used. For example, and without being limitative, the embodiment illustrated in FIG. 2A-B may include a dancer bar displacement sensor.

Figure 3A:
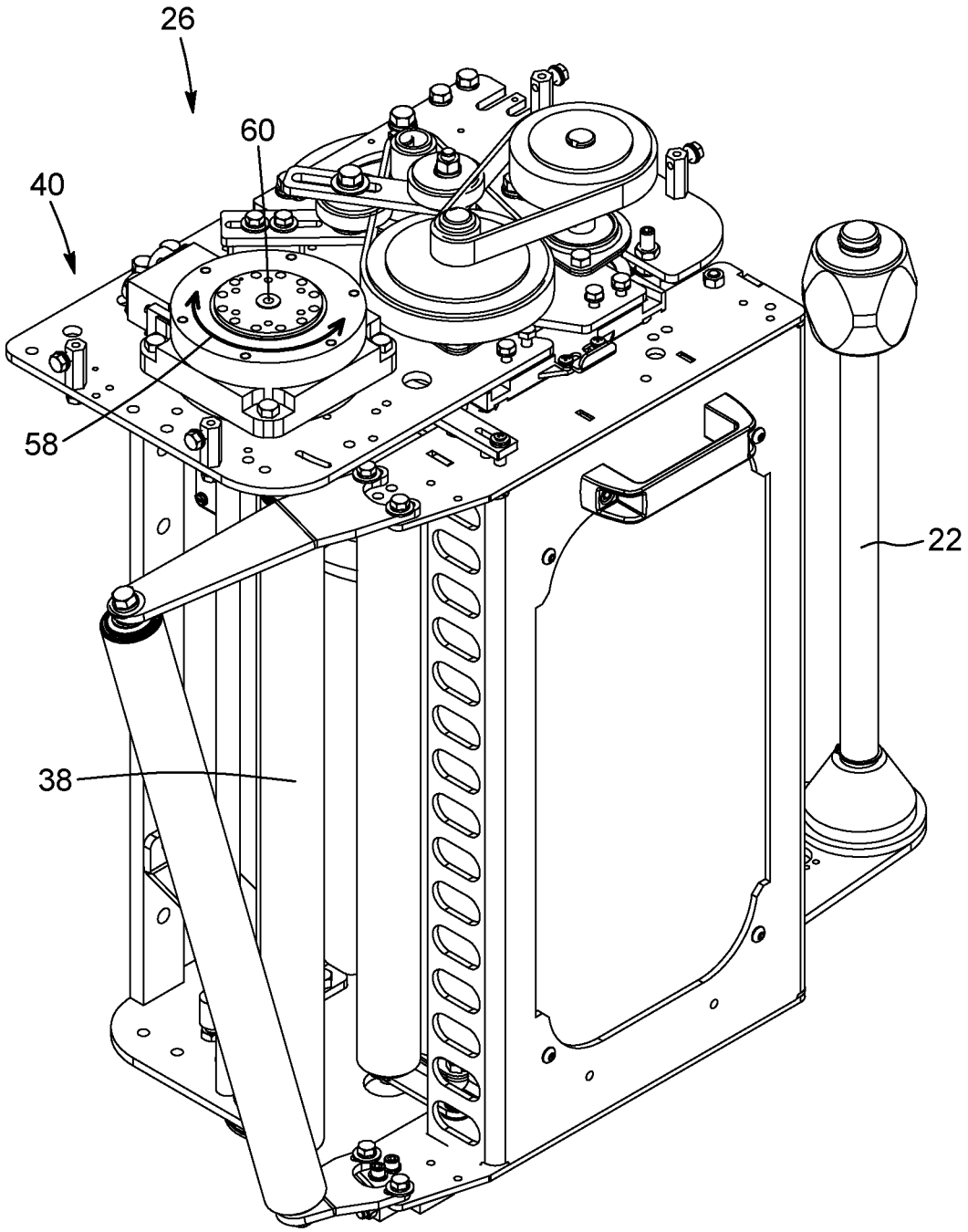
FIGS. 3A-B are respectively a perspective view and a front view of a dancer bar assembly for a film dispenser, in accordance with another embodiment wherein the dancer bar is operatively connected to a servo motor.
Figure 3B:
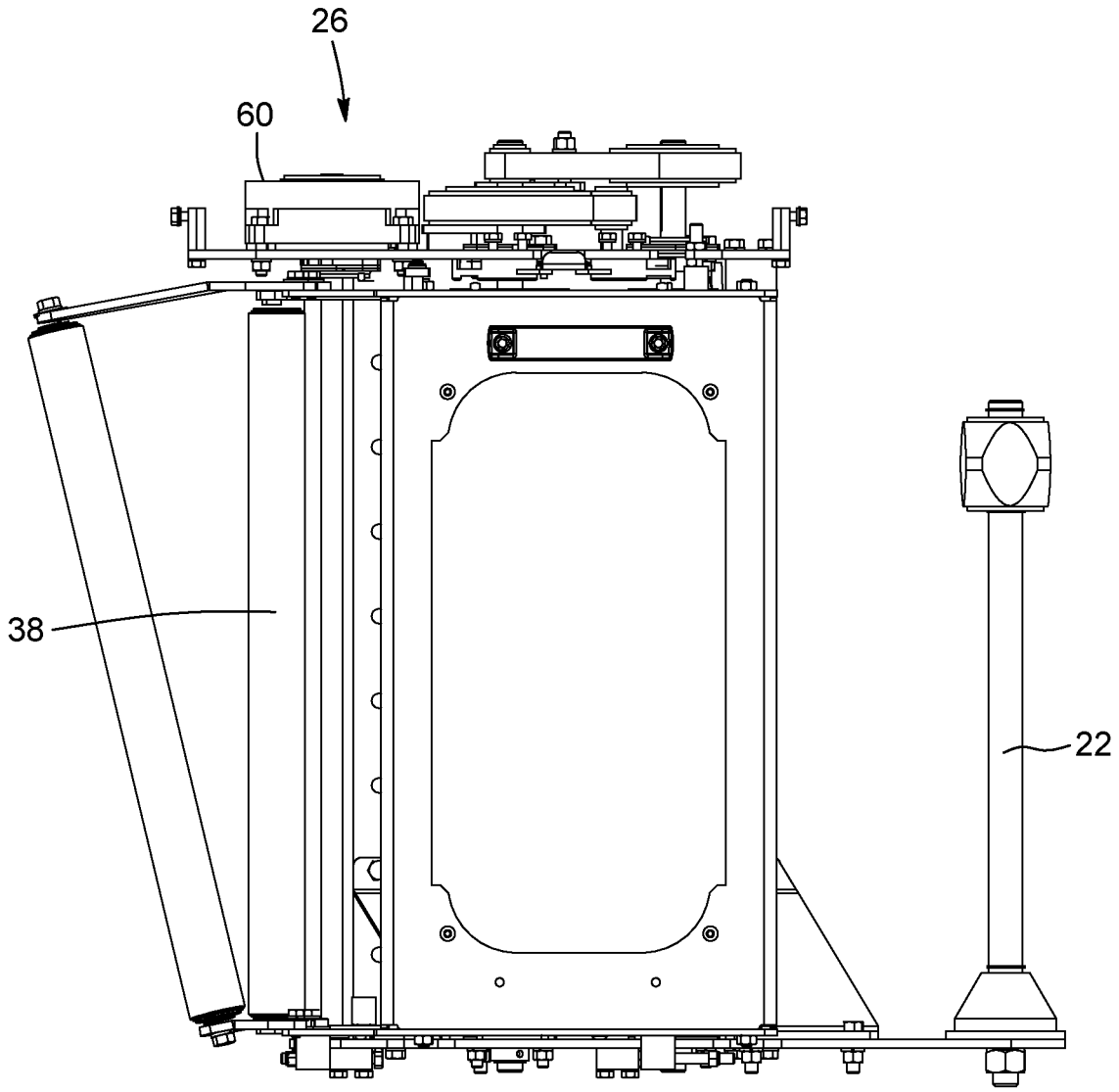

Now turning to FIGS. 3A-B, instead of being displaceable along a translational degree of freedom, the dancer bar 38 could be displaceable along a rotational degree of freedom 58, i.e., the displacement of the dancer bar 38 can be a rotation between the first position and the at least one second position. For example, the dancer bar 38 can be rotatable about a rotation axis. In these embodiments, the first and the at least one second positions of the dancer bar 38 are angular positions relative to the radius of the dancer bar 38 (i.e., the segment extending from the center of the dancer bar 38 to the outer periphery of the dancer bar 38, which typically has a circular or almost circular cross-section).

In some embodiments, such as the one illustrated in FIGS. 3A-B, the dancer bar control assembly 40 includes a rotatory servo motor 60 operatively connected to the first end of the dancer bar 38. In use, the rotatory servo motor 60 is configured to guide the first end in rotation and to measure a rotation angle of the first end. The rotatory servo motor 60 is configured to monitor, detect and measure an angular position of the dancer bar 38. More particularly, the rotatory servo motor 60 tracks the rotational positioning of the dancer bar 38, i.e., the relative rotation of the outer periphery of the dancer bar 38 with respect to the center of the dancer bar 38. When the rotatory servo motor 60 detects that the dancer bar 38 is in the first position (i.e., when there is no tension applied on or to the dancer bar 38, or when the tension is below or equal to the threshold), the rotatory servo motor 60 remains in standby. However, when the threshold is reached or exceeded, the dancer bar 38 engages in a rotation and moves towards one of the second positions. The rotatory servo motor 60 is configured to measure the angular displacement of the dancer bar 38 and bias the dancer bar 38 with a constant force. Upon detection of a displacement equal or above the threshold, the servo motors send a speed command to the film dispenser motor or the pre-stretch motor in order to adjust the film delivery speed, thereby lowering the tension applied on the dancer bar 38 and engaging the dancer bar 38 in rotation to return towards the first position. Appropriate sensor(s), actuator(s) and/or controller(s), such as the ones which have been previously described, could be used. For example, and without being limitative, the embodiment illustrated in FIG. 3A-B may include an angular position sensor.

Figure 4A:
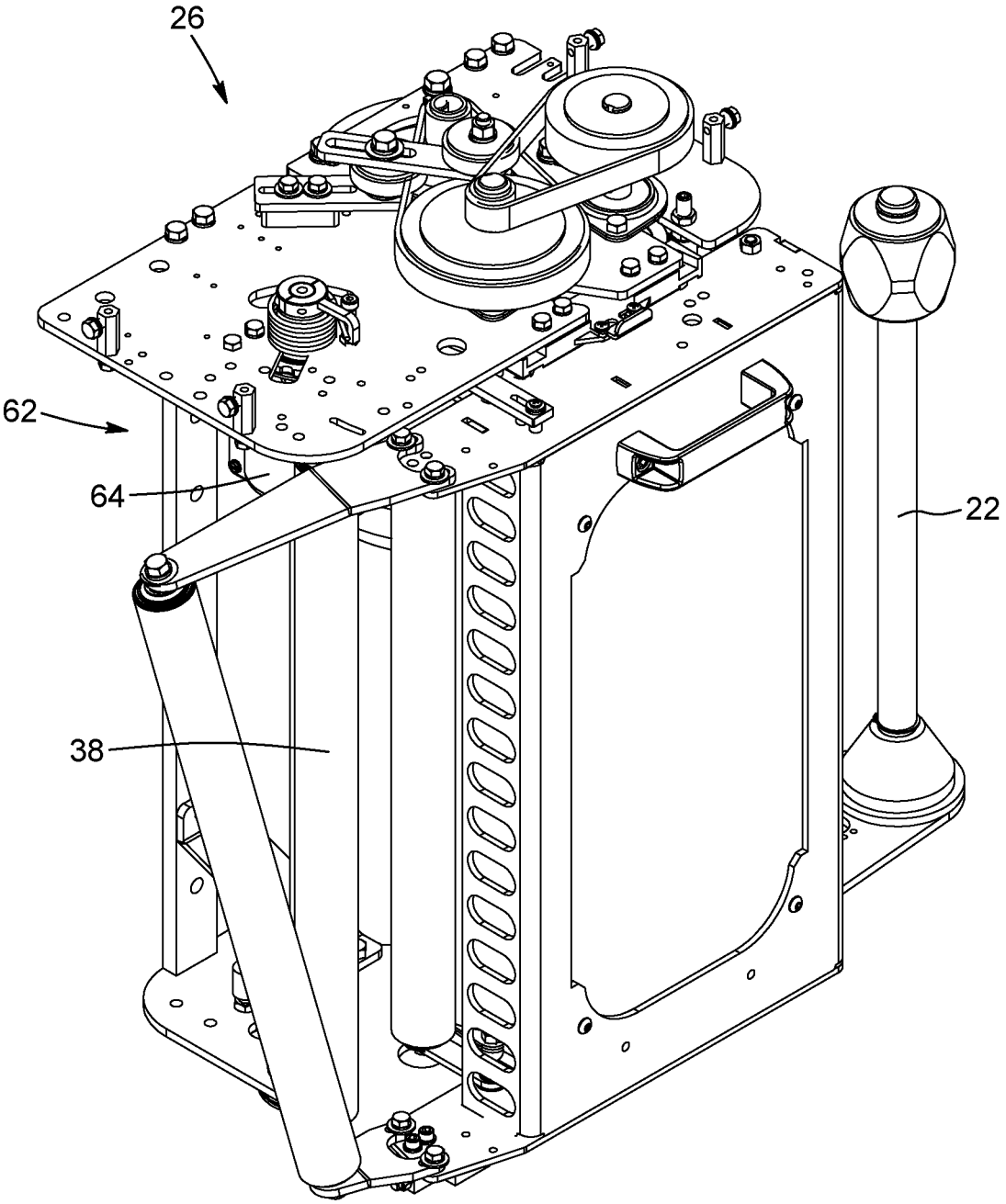
FIGS. 4A-B are respectively a perspective view and a front view of a film dispenser for a wrapping apparatus, in accordance with another embodiment wherein the dancer bar is operatively connected to a linear biasing member.
Figure 4B:
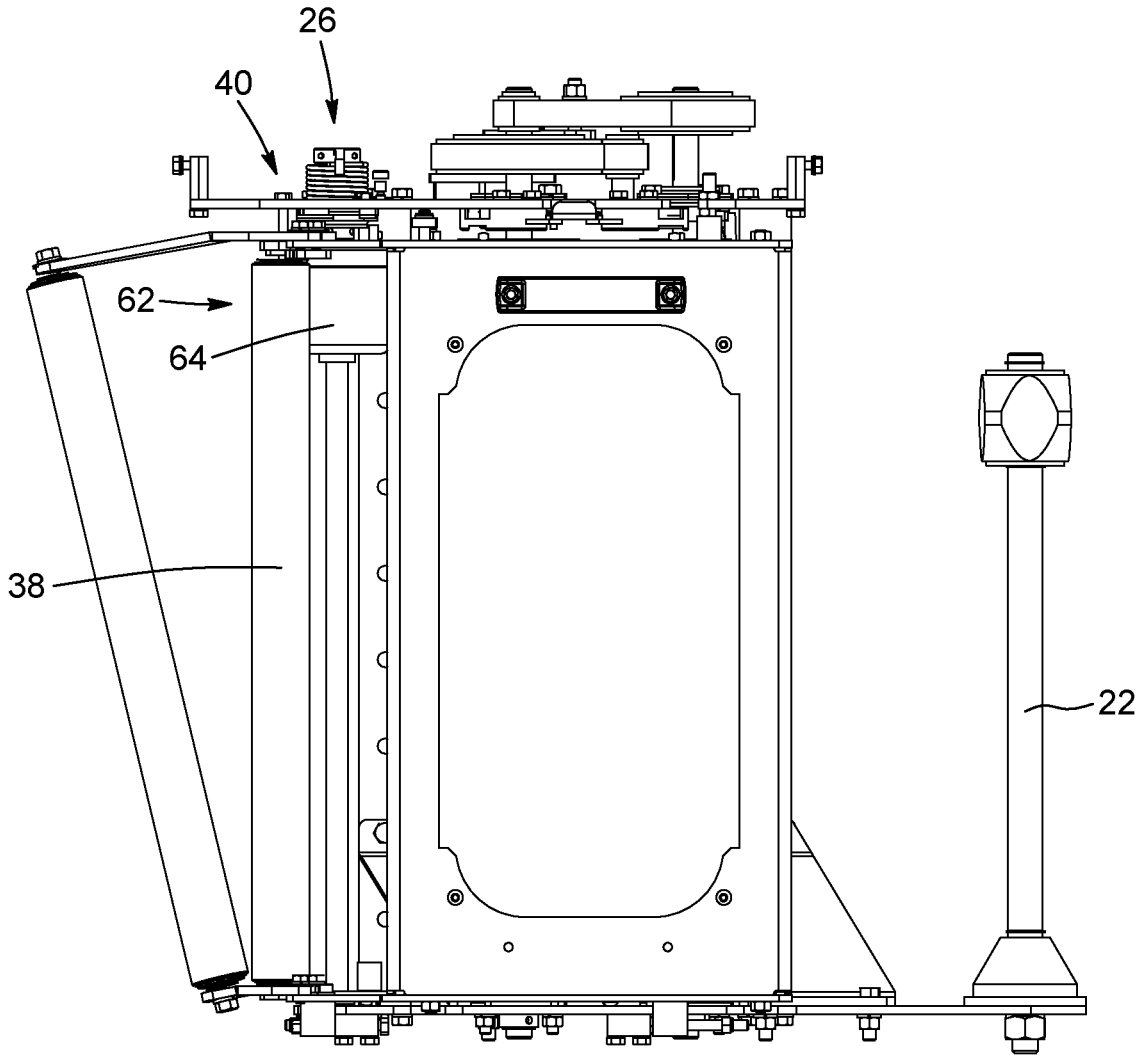

In some embodiments, such as the one illustrated in FIGS. 4A-B, the dancer bar control assembly 40 includes a magnetic assembly 62 and may include a sensor (not shown).

The magnetic assembly 62 may include a permanent magnet (not shown in the Figures) mounted inside the dancer bar 38. For example, and without being limitative, the permanent magnet can be mounted near the first end of the dancer bar 38. Alternatively, the permanent magnet could be mounted elsewhere within the dancer bar 38, such as the second end. The magnetic assembly 62 also includes an inductive magnet 64, which may include an electrical conductor, mounted around the dancer bar 38. The inductive magnet 64 may be mounted around the dancer bar 38 near or at the first or second end, depending on the positioning of the permanent magnet. The configuration of the magnetic assembly 62 is such that the electrical conductor is provided around of or around at least a portion of the permanent magnet. In some embodiments, the inductive magnet 64 may be mounted inside the dancer bar 38, and the permanent magnet mounted around the dancer bar 38. Appropriate sensor(s), actuator(s) and/or controller(s), such as the ones which have been previously described, could be used.

The sensor is operatively connected to the magnetic assembly 62 and is configured to measure an angular position of the dancer bar 38. The magnetic assembly 62 biases the dancer bar 38 towards its first position.

In some embodiments, the permanent magnet is inserted in the dancer bar 38, at an end portion thereof, and an adjustable inductive magnet may be mounted to the frame and around the end portion of the dancer bar 38 including the permanent magnet. The angular position of the dancer bar 38 is monitored and controlled using the combination of the permanent and adjustable inductive magnet 64 and the sensor.

Figure 5A:
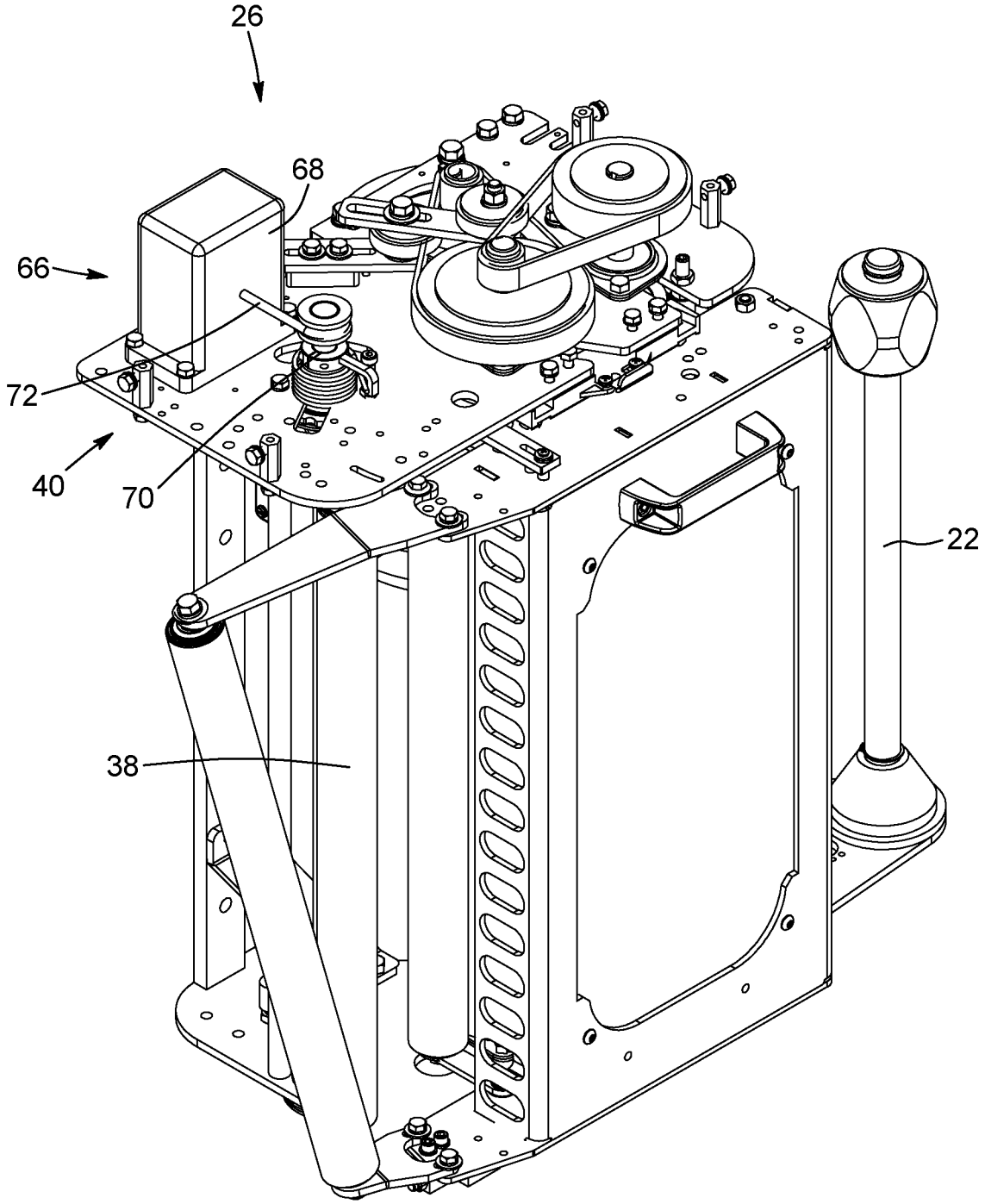
FIG. 5A-B are respectively a perspective view and a front view of a film dispenser for a wrapping apparatus, in accordance with another embodiment wherein the dancer bar is operatively connected to a non-linear biasing member.
Figure 5B:
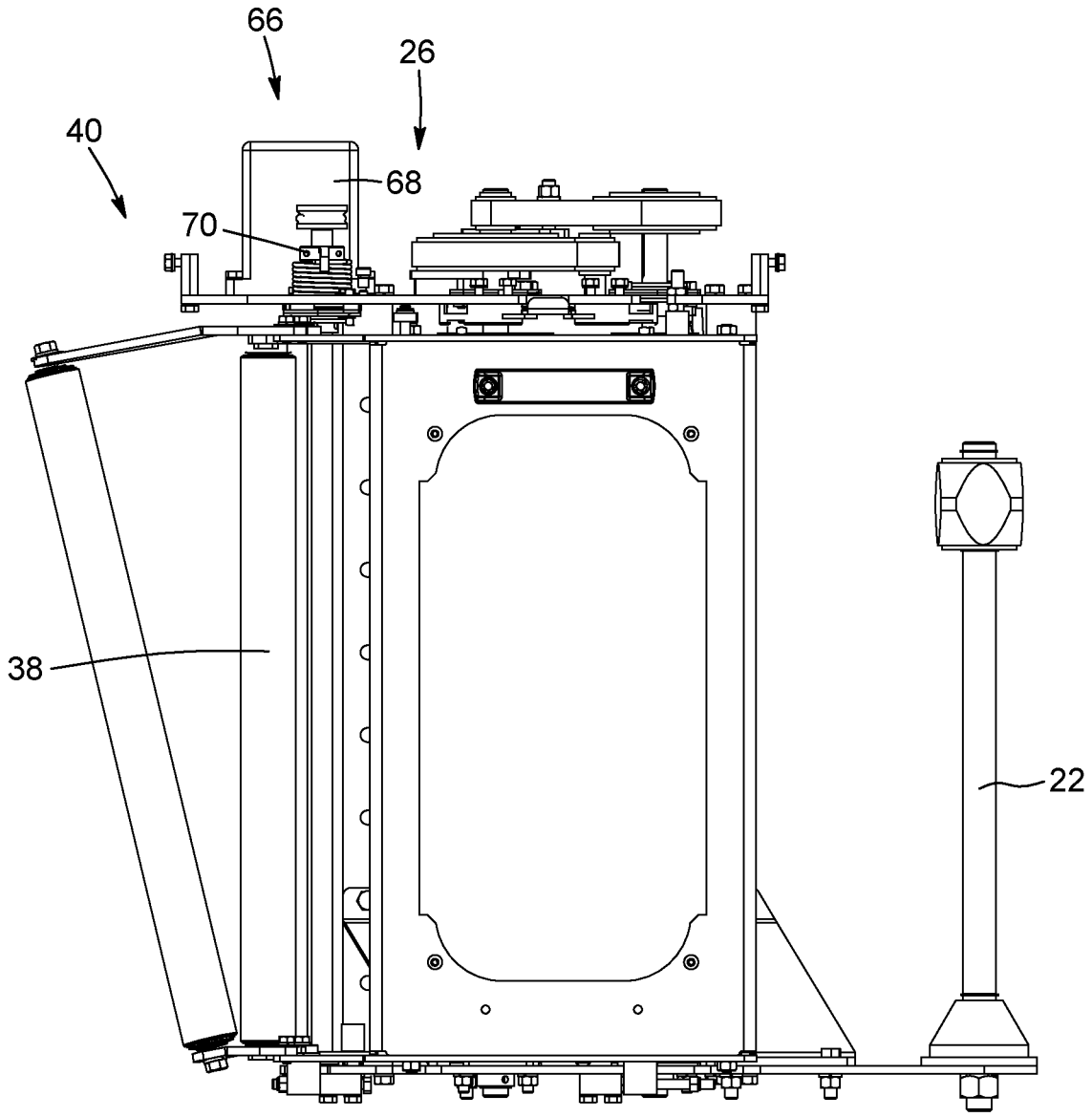

In some embodiments, such as the one illustrated in FIGS. 5A-B, the dancer bar control assembly 40 comprises a magnetic assembly 66 including a magnetic spring 68, a reel 70 mountable near or at a first end of the dancer bar 38 and a cable 72. The reel 70 is engageable in rotation with the dancer bar 38. The cable 72 is operatively connected to the magnetic spring 68. The cable 72 can be wounded around the reel 70 upon rotation of the dancer bar 38. The dancer bar control assembly 40 also includes a sensor (sometimes referred to as a linear displacement sensor). The sensor (or linear displacement sensor) is operatively connected to the magnetic assembly 66 and is configured to measure a linear displacement of the cable 72. The magnetic assembly 66 biases the dancer bar 38 through the cable 72 and the reel 70.

In some embodiments, the cable 72 is engaged with a pulley mounted to the shaft of the dancer bar 38 at an end thereof. The cable 72 is inserted in an adjustable magnet providing a constant force. The angular position of the dancer bar 38 and/or the linear position of the cable 72 with respect to the adjustable magnet 68 or the pulley (e.g., a portion being wound thereon) can be monitored by monitoring the position of the cable 72.

In some embodiments, the magnetic spring 68 is a MagSpring (as commercialize by LinMot®). Such a magnetic spring can supply a constant force for any position of the spring. In some embodiments, the force can be adjusted but remains constant for any positions of the spring, which could be suitable for adjusting the force, depending on the load being wrapped or the wrapping phase. For instance, it is sometimes required to provide a higher value of tension while going upward and a lower value of tension while wrapping downwardly. The magnetic spring 68 could be used with a controller or a detector.

In some embodiments, the threshold is a tension value. The threshold could be, for example and without being limitative, about 10 pounds. The threshold is generally included in a range extending from about 1 pound to about 20 pounds. The threshold can be adjustable, i.e., the value of the threshold can be changed (by an operator and/or automatically).

In some embodiments, the dancer bar control assembly 40 is operatively connected to the pre-stretch assembly 26 and to the dancer bar 38, the dancer bar control assembly 40 being configured to bias the dancer bar 38 with a constant force over the displacement range, receive a measured position of the dancer bar 38 and adjust the film delivery speed to compensate for the variation of the film feed requirement based on the measured position.

Now turning to FIG. 6, there is illustrated an embodiment of the film dispenser 20 that does not include a pre-stretch assembly. This embodiment may be useful when non-stretchable material webs 24 are being used to wrap a load. The working principle of the film dispenser 20 illustrated in FIG. 6 is similar to the working principle of the film dispenser 20 illustrated in FIG. 1 but differs in that the film dispenser 20 of FIG. 6 is not configured to pre-stretch the material web 24 before the application of the material web 24 to a load. The other components of the film dispenser 20 illustrated in FIG. 6 are similar to the corresponding components illustrated in FIG. 1.

It is understood that the above examples of the film dispenser 20 may be used in a related method. Broadly described, the method includes a first general step of providing a material web 24 at a film delivery speed. The method includes engaging a dancer bar 38 with the material web 24 such that, in response to a variation of a film feed requirement, the dancer bar 38 is configured to move from a first position towards at least one second position when a tension in the material web 24 is above a threshold and remains in the first position when the tension in the film is below or equal to the threshold. The method includes biasing the dancer bar 38 with a constant force over the displacement range of the dancer bar 38, as it has been previously described. The method includes monitoring a position of the dancer bar 38. The method also includes adjusting the film delivering speed based on the displacement of the dancer bar 38, thereby compensating for the variation of the film feed requirement.

In some embodiments, the method includes operating the dancer bar control assembly 40 to bias the dancer bar 38 with a constant force over the displacement range, monitor a displacement of the dancer bar 38 and generate a speed command based on the monitored displacement of the dancer bar 38 and send the speed command towards a motor of the film dispenser (e.g., the film dispenser motor 28) or the pre-stretch motor 26 adjust the film delivery speed.

In some embodiments, the method includes pre-stretching the web material.

In some embodiments, the method includes monitoring a linear displacement of the dancer bar 38, i.e., monitoring a translation of the dancer bar 38 between a first position and at least one second position.

In other embodiments, the method includes monitoring an angular position of the dancer bar 38, i.e., a rotation of the dancer bar 38 between a first position and at least a second position.

In some embodiments, the threshold is a tension value. The threshold can be, for example and without being limitative, comprised in a range extending from about 1 pound to about 20 pounds. In some embodiments, the tension value is about 10 pounds. The method could include a step of adjusting the threshold, for example in the circumstances in which the threshold is an adjustable value.

Several alternative embodiments and examples have been described and illustrated herein. The embodiments described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. The present examples and embodiments, therefore, are to be considered in all respects as illustrative and not restrictive. Accordingly, while specific embodiments have been illustrated and described, numerous modifications come to mind without significantly departing from the scope defined in the appended claims.

The invention claimed is:

1. A film dispenser for a wrapping apparatus, comprising:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards a film dispenser motor to adjust the film delivery speed;

wherein the dancer bar control assembly comprises:

a biasing actuator configured to bias the dancer bar towards the first position;

a dancer bar displacement sensor configured to monitor the displacement of the dancer bar relative to the first position; and a controller operatively connected to the dancer bar displacement sensor and to the film dispenser motor, the controller being configured to generate and send the speed command.

2. The film dispenser of claim 1, further comprising a pre-stretch assembly configured to pre-stretch the material web.

3. The film dispenser of claim 1, wherein a value of the constant force is adjustable.

4. The film dispenser of claim 1, wherein the threshold is a tension value.

5. A film dispenser for a wrapping apparatus, comprising:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards a film dispenser motor to adjust the film delivery speed;

wherein the displacement of the dancer bar is a translation between the first position and the at least one second position; and wherein the dancer bar control assembly comprises:

a first linear servo motor operatively connected to a first end of the dancer bar, the first linear servo motor being configured to detect and guide a translation of the first end along a first axis; and a second linear servo motor operatively connected to a second end of the dancer bar, the second linear servo motor being configured to detect and guide a translation of the second end along a second axis.

6. The film dispenser of claim 5, further comprising a pre-stretch assembly configured to pre-stretch the material web.

7. The film dispenser of claim 5, wherein a value of the constant force is adjustable.

8. The film dispenser of claim 5, wherein the threshold is a tension value.

9. The film dispenser of claim 5, wherein the first and second axes are substantially parallel one to another.

10. A film dispenser for a wrapping apparatus, comprising:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards a film dispenser motor to adjust the film delivery speed;

wherein the displacement of the dancer bar is a rotation between the first position and the second position, and the dancer bar is rotatable about a rotation axis; and wherein the dancer bar control assembly comprises a rotatory servo motor operatively connected to a first end of the dancer bar, the rotatory servo motor being configured to detect and guide a rotation of the first end about the rotation axis.

11. The film dispenser of claim 10, further comprising a pre-stretch assembly configured to pre-stretch the material web.

12. The film dispenser of claim 10, wherein a value of the constant force is adjustable.

13. The film dispenser of claim 10, wherein the threshold is a tension value.

14. The film dispenser of claim 10, wherein the rotatory servo motor is configured to measure an angular displacement of the dancer bar.

15. A film dispenser for a wrapping apparatus, comprising:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards a film dispenser motor to adjust the film delivery speed;

wherein the displacement of the dancer bar is a rotation between the first position and the second position, and the dancer bar is rotatable about a rotation axis; and wherein the dancer bar control assembly comprises:

a magnetic assembly comprising a permanent magnet mounted inside the dancer bar and an inductive magnet mounted around the dancer bar; and an angular position sensor configured to measure an angular position of the dancer bar.

16. The film dispenser of claim 15, further comprising a pre-stretch assembly configured to pre-stretch the material web.

17. The film dispenser of claim 15, wherein a value of the constant force is adjustable.

18. The film dispenser of claim 15, wherein the threshold is a tension value.

19. A film dispenser for a wrapping apparatus, comprising:

a dispenser roller configured to provide a material web at a film delivery speed;

a film dispenser motor operatively connected to the dispenser roller;

a dancer bar positioned downstream of the dispenser roller and being engageable with the material web, the dancer bar being movable over a displacement range between a first position and at least one second position in response to a variation of a film feed requirement, the dancer bar being in the first position when a tension in the material web is below a threshold and being in the at least one second position when the tension in the material web is equal or above the threshold; and a dancer bar control assembly operatively connected to the dancer bar, the dancer bar control assembly being configured to:

bias the dancer bar with a constant force over the displacement range;

monitor a displacement of the dancer bar; and generate a speed command based on the monitored displacement of the dancer bar and send the speed command towards a film dispenser motor to adjust the film delivery speed;

wherein the displacement of the dancer bar is a rotation between the first position and the second position, and the dancer bar is rotatable about a rotation axis;

and wherein the dancer bar control assembly comprises:

a magnetic assembly, comprising:

a magnetic spring;

a reel mountable near or at a first end of the dancer bar, the reel being engageable in rotation with the dancer bar; and a cable operatively connected to the magnetic spring, the cable being wounded around the reel upon rotation of the dancer bar; and a linear position sensor configured to measure a linear displacement of the cable.

20. The film dispenser of claim 19, further comprising a pre-stretch assembly configured to pre-stretch the material web.

21. The film dispenser of claim 19, wherein a value of the constant force is adjustable.

22. The film dispenser of claim 19, wherein the threshold is a tension value.

* * * * *